US008283287B2

(12) United States Patent
Aihara et al.

(10) Patent No.: US 8,283,287 B2
(45) Date of Patent: Oct. 9, 2012

(54) THERMOSENSITIVE RECORDING MATERIAL

(75) Inventors: Hideo Aihara, Fuji (JP); Ichiro Sawamura, Numazu (JP); Hiroshi Tohmatsu, Numazu (JP); Shinji Okada, Shiauoka (JP); Hirokazu Watari, Numazu (JP)

(73) Assignee: Ricoh Company, Ltd., Tokyo (JP)

( * ) Notice: Subject to any disclaimer, the term of this patent is extended or adjusted under 35 U.S.C. 154(b) by 1043 days.

(21) Appl. No.: 12/208,848

(22) Filed: Sep. 11, 2008

(65) Prior Publication Data

US 2009/0075817 A1 Mar. 19, 2009

(30) Foreign Application Priority Data

Sep. 13, 2007 (JP) ..... 2007-237410
Jan. 10, 2008 (JP) ..... 2008-003582

(51) Int. Cl.
*B41M 5/30* (2006.01)

(52) U.S. Cl. ..... 503/226; 503/200

(58) Field of Classification Search ..... None
See application file for complete search history.

(56) References Cited

U.S. PATENT DOCUMENTS

| | | | | |
|---|---|---|---|---|
| 4,950,638 | A | 8/1990 | Yuyama et al. | |
| 4,975,408 | A | 12/1990 | Motosugi et al. | |
| 5,037,696 | A | 8/1991 | Miyake et al. | |
| 5,087,603 | A | 2/1992 | Izubayashi et al. | |
| 5,102,693 | A | 4/1992 | Motosugi et al. | |
| 5,189,007 | A | 2/1993 | Aihara et al. | |
| 5,194,418 | A | 3/1993 | Miyauchi et al. | |
| 5,229,349 | A | 7/1993 | Kurisu et al. | |
| 5,284,900 | A | 2/1994 | Izubayashi et al. | |
| 5,482,911 | A | 1/1996 | Hiroishi et al. | |
| 5,712,221 | A | 1/1998 | Goto et al. | |
| 5,792,724 | A | 8/1998 | Suzaki et al. | |
| 5,866,507 | A | 2/1999 | Suzaki et al. | |
| 5,866,508 | A | 2/1999 | Sawamura et al. | |
| 5,935,899 | A | 8/1999 | Suzaki et al. | |
| 5,952,263 | A | 9/1999 | Suzaki et al. | |
| 5,977,019 | A * | 11/1999 | Ozeki et al. | 503/204 |
| RE38,496 | E | 4/2004 | Sawamura et al. | |
| 2006/0205593 | A1 | 9/2006 | Kadota et al. | |
| 2008/0182749 | A1 | 7/2008 | Tohmatsu et al. | |

FOREIGN PATENT DOCUMENTS

| | | |
|---|---|---|
| JP | 1-128871 | 5/1989 |
| JP | 2-29383 | 1/1990 |
| JP | 2-217266 | 8/1990 |
| JP | 2-258288 | 10/1990 |
| JP | 3-190787 | 8/1991 |
| JP | 4-219277 | 8/1992 |

(Continued)

OTHER PUBLICATIONS

European search report in connection with a counterpart European patent application No. 08 16 4249.

(Continued)

*Primary Examiner* — Bruce H Hess
(74) *Attorney, Agent, or Firm* — Cooper & Dunham LLP

(57) ABSTRACT

A thermosensitive recording material including a support, a thermosensitive recording layer composed mainly of a leuco dye and a developer, provided on one surface of the support, and a back layer provided on the other surface of the support, wherein the back layer contains an isobutylene-maleic anhydride copolymer ammonium salt, and at least one of an aziridine compound, and a cross-linked product of the isobutylene-maleic anhydride copolymer ammonium salt and the aziridine compound.

10 Claims, 1 Drawing Sheet

Present Invention

FOREIGN PATENT DOCUMENTS

| | | |
|---|---|---|
| JP | 6-239019 | 8/1994 |
| JP | 6-316155 | 11/1994 |
| JP | 7-81231 | 3/1995 |
| JP | 8-216445 | 8/1996 |
| JP | 10-181205 | 7/1998 |
| JP | 2919062 | 4/1999 |
| JP | 3161774 | 2/2001 |
| JP | 3248993 | 11/2001 |
| JP | 3311409 | 5/2002 |
| JP | 2003-25731 | 1/2003 |
| JP | 2003-276330 | 9/2003 |
| JP | 3497699 | 11/2003 |
| JP | 2004-284089 | 10/2004 |
| JP | 3616839 | 11/2004 |
| JP | 2005-319700 | 11/2005 |
| JP | 3780463 | 3/2006 |
| JP | 2006-168319 | 6/2006 |
| JP | 2006-289962 | 10/2006 |

OTHER PUBLICATIONS

Oct. 6, 2011 Japanese official action in connection with a counterpart Japanese patent application.

U.S. Appl. No. 06/874,950, filed Jun. 16, 1986 (abandoned).

Nov. 22, 2011 Japanese official action in connection with a counterpart Japanese patent application.

* cited by examiner

Present Invention

THERMOSENSITIVE RECORDING MATERIAL

BACKGROUND OF THE INVENTION

1. Field of the Invention

The present invention relates to a thermosensitive recording material which reduces curling toward a print surface before and after printing, concerning a sheet-like thermosensitive recording medium for a thermosensitive printer, which utilizes color-developing reaction between an electron-donating color-forming compound and an electron-accepting compound; and the present invention relates specifically to a thermosensitive recording material for medical images.

2. Description of the Related Art

A thermosensitive recording medium generally includes a support made of paper, synthetic paper, plastic film or the like, and a thermosensitive color-developing layer which is provided on one surface of the support and which contains as main components a colorless or pale color-forming material such as an electron-donating leuco dye, an organic acid developer such as an electron-accepting phenolic compound, and a binder; and it is possible to obtain a color-developed recorded image by making the color-forming dye and the developer react together, with the utilization of thermal energy, pressure, etc. Recording materials like this have been proposed in many varieties, and thermosensitive recording materials among them are advantageous in that complicated processes such as development and fixation are not required, recording is made possible in a short period of time with a relatively simple apparatus, noise does not arise much, and the costs are low, for example; accordingly, the thermosensitive recording materials are widely used as recording materials for electronic calculators, facsimiles, ticketing machines, label printers, printers for CRT medical measurement, CAD printers, recorders, scientific measurers, plotters and the like.

Each of these thermosensitive recording materials is generally produced by applying the color-forming dye and the developer onto paper. As a system that meets such a requirement, there is a thermosensitive recording process with a thermosensitive recording material; since the thermosensitive recording material for such use is required to have printing uniformity and stiffness comparable to that of a conventional silver halide X-ray film and be free of paper powder or the like which may lead to a printing defect, the thermosensitive recording material has been produced by applying the color-forming dye and the developer not onto paper but onto biaxially-stretched synthetic paper composed mainly of a plastic support, particularly polypropylene.

As to such a thermosensitive recording material with a plastic support, since the heat resistance of the support itself is low in comparison with that of a support made of paper, there is a problem in which printing by a thermal head causes the plastic support to contract and thus a film lifts, namely curls, toward the print surface. Before printing as well, there is a problem that when a thermosensitive recording layer and a protective layer are applied onto the support and dried, the film curls toward the surface because of expansion and contraction of the support and the applied layers. Curling caused by expansion and contraction of the applied layers is particularly conspicuous in the case of a thermosensitive recording medium which is provided with a layer composed mainly of a high Tg resin for the purpose of yielding a high surface glossiness of 60% or greater. As methods for reducing the curling, the following applications have been published.

Japanese Patent Application Laid-Open (JP-A) Nos. 2004-284089 and 10-181205 each disclose a method for reducing curling by using an acrylic resin for the inside of a back layer. JP-A Nos. 2003-276330 and 06-239019 each disclose a method for reducing curling by using a core-shell acrylic resin for the inside of a back layer. However, these methods are insufficient to prevent curling caused by contraction of a support, which occurs especially when a synthetic paper support is used, as described above. Moreover, there are such problems that the back layer has less adhesiveness to the support than it should, and that applied layers easily crack.

Meanwhile, JP-A No. 2006-168319 describes a method for improving water resistance by adding a specific maleic acid resin into a back layer; however, the addition of only the specific maleic acid resin is insufficient to prevent curling caused by contraction of a support, which occurs especially when a synthetic paper support is used, as described above.

Further, Japanese Patent (JP-B) No. 3161774 describes a thermosensitive recording material in the form of a roll, in which a carboxylic acid-modified polyvinyl alcohol and polyamide epihalohydrin are used for an overcoat layer, and polyvinyl alcohol and an aziridine compound are used for a back layer. JP-B No. 3616839 describes a thermosensitive recording material in which a core-shell emulsion resin and an aziridine compound are used for a back layer. However, the provision of the back layer containing polyvinyl alcohol and an aziridine compound or the back layer containing a core-shell emulsion resin and an aziridine compound is insufficient to prevent curling caused by contraction of a support, which occurs especially when a synthetic paper support is used, as described above.

Among these thermosensitive recording materials, thermosensitive paper in which multilayered synthetic paper is provided as a support is used in the following cases: the case where water resistance and tensile strength are required; the case where used in an image printer for CRT medical measurement, which requires uniformity and high resolution of recorded images; and the case where used in a CAD plotter, which requires dimensional stability and thin line recording.

In the field of medical treatment, internal body conditions able to be viewed using X-rays, MRI, CT scans, etc. have been made into visible images on silver halide film, and those images have been visually observed for diagnosis and referred to by means of backlight employed in the film viewing method. However, the wet process for the silver halide film presents a problem with waste liquid disposal; further, along with the recent digitization of images, emergence of a dry process to take the place of it has been demanded, and there have already been cases where a thermosensitive recording system is put to medical use and designed for reference in diagnosis with a monitor that displays digital images, or for diagnosis by visual observation with output digital images, as well as for CRT medical measurement.

Thermosensitive recording materials for medical use are generally classified into the reflection type in which recording material has little or no light transmittance as a whole, and a formed image is viewed by means of reflection of light; and the transmissive type in which recording material has light transmittance as a whole, and the light transmittance is utilized. The present invention concerns the reflection type in which a formed image is viewed by means of reflection of light.

The properties required for an image on thermosensitive paper to be used as a reflection-type medical image for reference or diagnosis by visual observation are as follows: uniformity, high resolution, thin line recording capability, high glossiness, water resistance, curl reducing capability, dimensional stability and tensile strength of the recorded image.

Accordingly, multilayered synthetic paper is provided as a support in the thermosensitive paper.

However, multilayered synthetic paper serving as a support in thermosensitive paper used for an electronic calculator, a facsimile, an automated ticketing machine, a scientific measurer, a CAD printer, a plotter, etc. is provided with depressions and protrusions on a surface thereof to improve printing suitability and writing capability as necessary properties, and some of the protrusions have heights unsuitable for a support of a thermosensitive recording medium for reflection-type medical images. When a medical image is recorded onto thermosensitive recording paper which includes such a support, there is, for example, a problem that white spots are formed at a halftone portion and a solid image recording portion, thus leading to a decrease in uniformity. Also, the provision of the depressions and the protrusions on the surface of the synthetic paper causes reduction in glossiness, and thus there is a problem that the high glossiness required for reflection-type medical thermosensitive paper to show a photograph-like image cannot be yielded. Moreover, the surface of the multilayered synthetic paper is provided with the depressions and the protrusions, whereas the other surface thereof has a different structure; thus, when the multilayered synthetic paper is formed into a sheet, the degree of curling is great, which is problematic in the case where a medical image is observed.

In order to remove the white spots formed at the halftone portion and the solid image recording portion, JP-A No. 03-190787 proposes and puts into practice a thermosensitive recording paper including a support, and a thermosensitive color-developing layer provided on the support, wherein the support is a synthetic paper composed of films in which a biaxially-stretched resin film serves as a base layer, and a uniaxially-stretched film made of a thermoplastic resin containing 10% by weight to 50% by weight of calcium carbonate powder is provided as a paper-like layer on a surface of the base layer, and wherein the support has the following properties (i) to (iii): (i) the opacity measured in accordance with JIS P-8138 is 45% or less; (ii) the Bekk smoothness of the paper-like layer onto which the thermosensitive color-developing layer is applied is 100 sec to 300 sec, and the center line average roughness (Ra) thereof is 1.5 μm or less; (iii) the density of the support measured in accordance with JIS P-8118 is 1.1 g/cm$^3$ or less.

Meanwhile, JP-A No. 07-81231 proposes a thermosensitive recording paper including a support, and a thermosensitive color-developing layer provided on one surface of the support, wherein the support is a synthetic paper composed of films in which a biaxially-stretched resin film serves as a base layer, a paper-like layer formed of a uniaxially-stretched film made of a thermoplastic resin containing 1% by weight to 8% by weight of calcium carbonate powder is provided on one surface of the base layer, and a back surface layer formed of a uniaxially-stretched film made of a thermoplastic resin containing 15% by weight to 55% by weight of fine inorganic powder is provided on the other surface of the base layer, and wherein the support has the following properties (i) to (iv): (i) the opacity measured in accordance with JIS P-8138 is 45% or less; (ii) the Bekk smoothness of the paper-like layer onto which the thermosensitive color-developing layer is applied is 1,000 sec to 3,500 sec, and the center line average roughness (Ra) thereof is 0.5 μm or less; (iii) the Bekk smoothness of the back surface layer is 100 sec to 900 sec, and the center line average roughness (Ra) thereof is 0.6 μm to 1 μm; (iv) the density of the support measured in accordance with JIS P-8118 is 0.91 g/cm$^3$ to 1.1 g/cm$^3$.

These supports make it possible to somewhat rectify, for example, the problem that protrusions having unsuitable heights cause white spots to be formed at a halftone portion and a solid image recording portion and thus there is a decrease in uniformity; however, they do not fully satisfy the requirements for reflection-type medical images, and the high image glossiness required cannot be yielded either. Moreover, since the front and back of the base layer have different structures, the degree of curling is great.

BRIEF SUMMARY OF THE INVENTION

An object of the present invention is to reduce curling of a film before and after printing, which occurs especially when a plastic support such as synthetic paper is used, in a thermosensitive recording material, and to provide a thermosensitive recording material including an appropriately glossy back layer which has necessary adhesiveness to a support and does not cause cracking or the like of the layer.

Means for solving the problems are as follows.

<1> A thermosensitive recording material including a support, a thermosensitive recording layer composed mainly of a leuco dye and a developer, provided on one surface of the support, and a back layer provided on the other surface of the support, wherein the back layer contains an isobutylene-maleic anhydride copolymer ammonium salt, and at least one of an aziridine compound, and a cross-linked product of the isobutylene-maleic anhydride copolymer ammonium salt and the aziridine compound.

<2> A thermosensitive recording material including a support, a thermosensitive recording layer composed mainly of a leuco dye and a developer, provided on one surface of the support, and a back layer provided on the other surface of the support, wherein the back layer contains at least an antistatic agent.

<3> The thermosensitive recording material according to <2>, wherein the antistatic agent is a polystyrene sulfonic acid salt.

<4>The thermosensitive recording material according to any one of <2> and <3>, wherein the antistatic agent is a salt of a copolymer of styrene sulfonic acid and maleic acid.

<5> The thermosensitive recording material according to any one of <2> to <4>, wherein in the back layer, 1 part by mass to 3 parts by mass of the antistatic agent is contained in relation to 1 part by mass of an isobutylene-maleic anhydride copolymer ammonium salt also contained.

<6> The thermosensitive recording material according to any one of <4> and <5>, wherein in the back layer, 0.2 parts by mass to 1 part by mass of an aziridine compound is contained in relation to 1 part by mass that is the total amount of the isobutylene-maleic anhydride copolymer ammonium salt and the salt of the copolymer of styrene sulfonic acid and maleic acid also contained.

<7> The thermosensitive recording material according to any one of <1> to <6>, wherein the back layer contains polyvinyl alcohol.

<8> The thermosensitive recording material according to <7>, wherein the back layer is obtained by applying and drying a coating solution which contains at least the isobutylene-maleic anhydride copolymer ammonium salt, the aziridine compound and the polyvinyl alcohol, and the mass ratio of the isobutylene-maleic anhydride copolymer ammonium salt to the polyvinyl alcohol in the coating solution is in the range of 3/7 to 9/1.

<9> The thermosensitive recording material according to any one of <1> to <8>, wherein the back layer contains an amorphous inorganic pigment having a volume average particle diameter of 1 μm to 3 μm, a spherical organic pigment having a volume average particle diameter of 5 μm to 7 μm, and a spherical organic pigment having a volume average particle diameter of 12 μm or greater.

<10> The thermosensitive recording material according to any one of <1> to <9>, wherein the support is a biaxially-stretched film composed mainly of polypropylene.

<11> A thermosensitive recording material including a support, and a thermosensitive recording layer containing a leuco dye and a developer, provided on one surface of the support, wherein the support is made of multilayered synthetic paper, and an inorganic pigment is contained only in a base layer of the synthetic paper.

<12> The thermosensitive recording material according to <11>, wherein the support is made of multilayered synthetic paper composed mainly of a thermoplastic resin, and two layers which are formed solely of polypropylene and contain no inorganic pigment are laid over the base layer containing the inorganic pigment.

<13> The thermosensitive recording material according to any one of <11> and <12>, wherein the support is made of multilayered synthetic paper, and all layers are biaxially stretched.

<14> The thermosensitive recording material according to any one of <11> to <13>, wherein the materials constituting the thermosensitive recording layer on the support have an average particle diameter of 2.0 μm or less.

<15> The thermosensitive recording material according to any one of <11> to <13>, wherein the surface glossiness measured in accordance with JIS P-8142 is 40% or greater with respect to {GS (75°)}.

<16> The thermosensitive recording material according to any one of <11> to <15>, wherein the support is made of multilayered synthetic paper, and layers containing no inorganic pigment and having the same structure are laid over both surfaces of the base layer containing the inorganic pigment.

<17> The thermosensitive recording material according to <16>, wherein the MD/CD ratio with respect to the stiffness of the support is in the range of 0.6 to 1.4.

<18> The thermosensitive recording material according to <17>, wherein the stiffness of the support in MD and the stiffness of the support in CD are both 500 mg±150 mg.

<19> The thermosensitive recording material according to any one of <16> to <18>, wherein a back layer containing a matte agent is provided on the other surface of the support.

<20> A recording method for the thermosensitive recording material according to any one of <11> to <19>, wherein the thermosensitive recording material is heated and made to develop color, using a printer which incorporates a thermal head.

<21> The method according to <20>, wherein the thermosensitive recording material is made to develop color with tones in accordance with a pulse control method.

<22> The method according to <20>, wherein the thermosensitive recording material is made to develop color with tones in accordance with a voltage control method.

According to the present invention, it is possible to provide a thermosensitive recording material capable of reducing curling thereof before printing, and after printing in the case where a thermal head is used, which is achieved by a thermosensitive recording material including a support, a thermosensitive recording layer composed mainly of a leuco dye and a developer that makes the leuco dye develop color upon heating, provided on one surface of the support, and a back layer provided on the other surface of the support, wherein the back layer contains an isobutylene-maleic anhydride copolymer ammonium salt, and an aziridine compound and/or a cross-linked product of the isobutylene-maleic anhydride copolymer ammonium salt and the aziridine compound.

Also according to the present invention, it is possible to provide a thermosensitive recording material superior in uniformity and capable of obtaining a highly glossy image, which is achieved by a thermosensitive recording material including a support, and a thermosensitive recording layer containing a leuco dye and a developer, provided on one surface of the support, wherein the support is made of multilayered synthetic paper, and an inorganic pigment is contained only in a base layer of the synthetic paper.

Further, the following have been found: use of polyvinyl alcohol in the back layer containing the isobutylene-maleic anhydride copolymer ammonium salt, and the aziridine compound and/or the cross-linked product of the isobutylene-maleic anhydride copolymer ammonium salt and the aziridine compound prevents cracking of applied layers; also, inclusion of an amorphous inorganic pigment having a volume average particle diameter of 1 μm to 3 μm, a spherical organic pigment having a volume average particle diameter of 5 μm to 7 μm and a spherical organic pigment having a volume average particle diameter of 12 μm or greater in the back layer makes it possible to obtain appropriate glossiness and reduce adhesion between the front surface of one sheet and the back surface of another sheet when these sheets are laid on top of each other, and enables the support to be suitably provided as a biaxially-stretched film composed mainly of polypropylene, with the foregoing being particularly effective when a thermosensitive recording material having a high surface glossiness of 60% or greater is produced.

According to the present invention, it is possible to provide a thermosensitive recording material which reduces curling before and after printing, does not cause cracking of a back layer and is excellent in glossiness and adhesiveness between films.

DETAILED DESCRIPTION OF THE INVENTION

Figure 1:
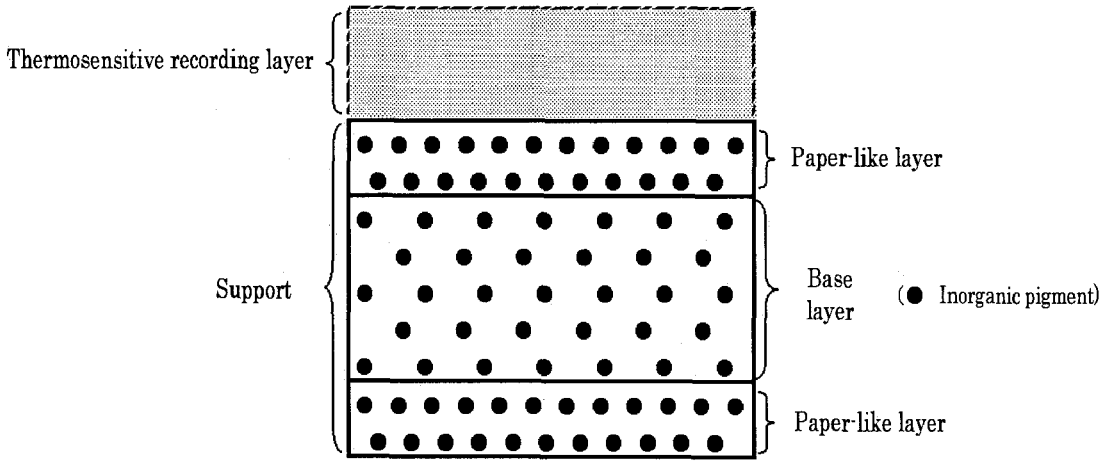
FIG. 1 Prior Art
FIG. 1 is a schematic diagram of a support and a thermosensitive recording layer in related art.
Figure 2:
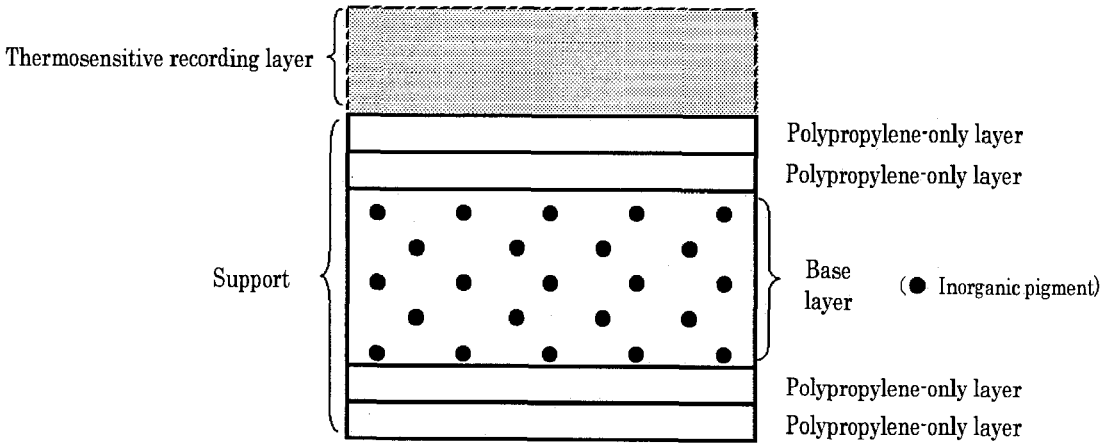
FIG. 2 is a schematic diagram of a support and a thermosensitive recording layer in the present invention.

The following explains a thermosensitive recording material of the present invention in further detail.

A thermosensitive recording material of the present invention includes a support, a thermosensitive recording layer composed mainly of a leuco dye and a developer that makes the leuco dye develop color upon heating, provided on one surface of the support, and a back layer provided on the other surface of the support. A resin-containing protective layer may be provided on the thermosensitive recording layer.

The support is selected from paper, polyester films such as of polyethylene terephthalate and polybutylene terephthalate, cellulose derivative films such as of cellulose triacetate, polyolefin films such as of polypropylene and polyethylene, and polystyrene films; and combinations of these films. Use of a biaxially-stretched film composed mainly of polypropylene as the support is particularly effective when a thermosensitive recording material having a high surface glossiness of 60% or greater is produced. The thickness of the support varies depending upon its use; the support preferably has a thickness of 50 μm to 250 μm when used for thermosensitive recording.

Examples of thermoplastic resins which form layers of the support include polyolefin resins such as polyethylene and polypropylene, ethylene-propylene copolymers, ethylene-vinyl acetate copolymers, poly(4-methylpentene-1), polystyrene, polyamides, polyethylene terephthalate, partial hydrolysates of ethylene-vinyl acetate copolymers, ethylene-acrylic acid copolymers and salts thereof, vinylidene chloride copolymers such as vinyl chloride-vinylidene chloride copolymers, and mixtures of these compounds.

Next, each layer will be explained.

(1) Base Layer

For a base layer, a film is used that is produced by biaxially stretching a composition composed of (a) 50% by mass to 95% by mass of polypropylene, (b) 0% by mass to 30% by mass of one or more thermoplastic resins selected from high-density polyethylene, medium-density polyethylene, low-density polyethylene and ethylene-vinyl acetate copolymers, and (c) 50% by mass to 5% by mass of fine inorganic powder. Since the base layer is formed of a biaxially-stretched film, deformation of the base layer is less likely to be biased toward one particular direction between the vertical and horizontal directions, which is favorable in that curling can be reduced.

Examples of the fine inorganic powder include fired clay, diatomaceous earth, talc, titanium oxide, barium sulfate, aluminum sulfate and silica, all of which are 20 μm or less in average particle diameter.

(2) Surface Layer

A surface layer is a composition composed of (a) 40% by mass to 100% by mass of polypropylene and (b) 60% by mass to 0% by mass of high-density polyethylene. In order to enhance the glossiness and smoothness of the surface, it is desirable that the surface layer be a thin film which has a thickness of 0.5 μm to 10 μm and is formed solely of polypropylene, and further, that the surface layer be formed by laying two such thin films on top of each other. Also, it is desirable that the surface layer be formed of a biaxially-stretched film because even higher glossiness can be obtained.

Additionally, it is desirable in view of reducing curling that surface layers having the same structure be formed on both front and back surfaces of the base layer.

Next, the thickness of each layer of the support will be explained.

It is appropriate that the thickness of a piece of multilayered synthetic paper be 40 μm to 800 μm, preferably 60 μm to 300 μm. The base layer occupies 40% or more of the synthetic paper in thickness.

The front surface layer and the back surface layer have a thickness of 0.5 μm to 10 μm each.

Pores are provided in the synthetic paper to such an extent that the porosity, defined by the following equation, becomes 15% to 65%. The draw ratio with respect to the vertical direction is 4 to 10, and the draw ratio with respect to the horizontal direction is 4 to 12. The stretching temperature with respect to vertical stretching is 140° C. to 158° C., and the stretching temperature with respect to horizontal stretching is higher than the melting point (163° C. to 168° C.) of polypropylene.

$$\text{Porosity}=(p0-p1)/p0\times 100(\%)$$

p0: film density before stretching p1: film density after stretching

It is desirable in view of reducing curling that the draw ratio for biaxial stretching be adjusted such that the MD (vertical direction)/CD (horizontal direction) ratio with respect to the stiffness of the support is in the range of 0.6 to 1.4.

It is further desirable in view of reducing curling that the stiffness of the support in MD (vertical direction) and the stiffness of the support in CD (horizontal direction) be both adjusted to 500 mg±150 mg.

The thermosensitive recording material of the present invention is formed by providing a thermosensitive recording layer, along with an intermediate layer and/or a protective layer if necessary, on the support delineated above.

A filler, a pigment, a surfactant, a thermofusible material and an antistatic agent that are known may be added into the thermosensitive recording layer in accordance with the necessity, besides the leuco dye, the developer and a binder resin that are contained in the thermosensitive recording layer as main components.

The leuco dye used in the thermosensitive recording layer of the present invention is selected from electron-donating compounds, and each of these compounds may be used alone or in combination with two or more. The leuco dye is a dye precursor which is colorless or pale per se, and the leuco dye is not particularly limited and may be suitably selected from conventionally known leuco dyes exemplified by leuco compounds based upon triphenylmethane, triphenylmethane phthalide, indolinophthalide, triallylmethane, fluoran, phenothiazine, thiofluoran, xanthene, indophthalyl, spiropyran, azaphthalide, chromenopyrazole, methines, rhodamineanilinolactam, rhodaminelactam, quinazoline, diazaxanthene, bislactone and auramine. Particular preference is given to fluoran-based leuco dyes and phthalide-based leuco dyes, and examples thereof include the following compounds; however, it should be noted that the leuco dye of the present invention is not limited thereto.

2-anilino-3-methyl-6-diethylaminofluoran, 2-anilino-3-methyl-6-(di-n-butylamino)fluoran, 2-anilino-3-methyl-6-(N-n-propyl-N-methylamino)fluoran, 2-anilino-3-methyl-6-(N-isopropyl-N-methylamino)fluoran, 2-anilino-3-methyl-6-(N-isobutyl-N-methylamino)fluoran, 2-anilino-3-methyl-6-(N-n-amyl-N-methylamino)fluoran, 2-anilino-3-methyl-6-(N-sec-butyl-N-ethylamino)fluoran, 2-anilino-3-methyl-6-(N-n-amyl-N-ethylamino)fluoran, 2-anilino-3-methyl-6-(N-iso-amyl-N-ethylamino)fluoran, 2-anilino-3-methyl-6-(N-n-propyl-N-isopropylamino)fluoran, 2-anilino-3-methyl-6-(N-cyclohexyl-N-methylamino)fluoran, 2-anilino-3-methyl-6-(N-ethyl-p-toluidino)fluoran, 2-anilino-3-methyl-6-(N-methyl-p-toluidino)fluoran, 3-diethylamino-7,8-benzofluoran, 1,3-dimethyl-6-diethylaminofluoran, 1,3-dimethyl-6-di-n-butylaminofluoran, 3-diethylamino-7-methylfluoran, 3-diethylamino-7-chlorofluoran, 3-diethylamino-6-methyl-7-chlorofluoran, 10-diethylamino-2-ethylbenzo[1,4]thiadino[3,2-b]fluoran, 3,3-bis(1-n-butyl-2-methylindole-3-yl)phthalide, 3, 3-bis(4-diethylamino-2-ethoxyphenyl)-4-azaphthalide, 3-[2,2-bis(1-ethyl-2-methyl-3-indolyl)vinyl]-3-(4-diethylaminophenyl)phthalide and 3-[1,1-bis(4-diethylaminophenyl)ethylene-2-yl]-6-dimethylaminophthalide.

3,3-bis(p-dimethylaminophenyl)-phthalide, 3,3-bis(p-dimethylaminophenyl)-6-dimethylaminophthalide (also referred to as "crystal violet lactone"), 3,3-bis(p-dimethylaminophenyl)-6-diethylaminophthalide, 3,3-bis(p-dimethylaminophenyl)-6-chlorphthalide, 3,3-bis(p-dibutylaminophenyl)phthalide, 3-cyclohexylamino-6-chlorfluoran, 3-dimethylamino-5,7-dimethylfluoran, 3-diethylamino-7-chlorofluoran, 3-diethylamino-7-methylfluoran, 3-diethylamino-7,3-benzfluoran, 3-diethylamino-6-methyl-7-chlorfluoran, 3-(N-p-tolyl-N-ethylamino)-6-methyl-7-anilinofluoran, 3-pyrrolidino-6-methyl-7-anilinofluoran, 2-{N-(3'-fluorotrimethylphenyl)amino}-6-diethylaminofluoran, 2-{3,6-bis(diethylamino)-9-(o-chloranilino)xanthyl benzoic acid lactam}, 3-diethylamino-6-methyl-7-(m-trichloromethylanilino)fluoran, 3-diethylamino-7-(o-chloranilino)fluoran, 3-di-n-butylamino-7-(o-chloranilino)fluoran, 3-N-methyl-N-n-amylamino-6-methyl-7-anilinofluoran, 3-N-methyl-N-cyclohexylamino-6-methyl-7-anilinofluoran, 3-diethylamino-6-methyl-7-anilinofluoran, 3-(N,N-diethylamino)-5-methyl-7-(N,N-dibenzylamino) fluoran, benzoyl leuco methylene blue, 6'-chloro-8'-methoxy-benzoindolino-spiropyran, 6'-bromo-3'-methoxy-benzoindolino-spiropyran, 3-(2'-hydroxy-4'-dimethylaminophenyl)-3-(2'-methoxy-5'-chlorphenyl) phthalide, 3-(2'-hydroxy-4'-dimethylaminophenyl)-3-(2'-methoxy-5'-nitrophenyl)phthalide, 3-(2'-hydroxy-4'-diethylaminophenyl)-3-(2'-methoxy-5'-methylphenyl) phthalide, 3-(2'-methoxy-4'-dimethylaminophenyl)-3-(2'-hydroxy-4'-chlor-5'-methylphenyl)phthalide, 3-(N-ethyl-N-tetrahydrofurfuryl)amino-6-methyl-7-anilinofluoran, 3-N-ethyl-N-(2-ethoxypropyl)amino-6-methyl-7-anilinofluoran, 3-N-methyl-N-isobutyl-6-methyl-7-anilinofluoran, 3-morpholino -7-(N-propyl-trifluoromethylanilino)fluoran, 3-pyrrolidino-7-m-trifluoromethylanilinofluoran, 3-diethylamino-5-chloro-7-(N-benzyl-trifluoromethylanilino)fluoran, 3-pyrrolidino-7-(di-p-chlorphenyl)methylaminofluoran, 3-diethylamino-5-chlor-7-(α-phenylethylamino)fluoran, 3-(N-ethyl-p-toluidino)-7-(α-phenylethylamino)fluoran, 3-diethylamino-7-(o-methoxycarbonylphenylamino)fluoran, 3-diethylamino-5-methyl-7-(α-phenylethylamino)fluoran, 3-diethylamino-7-piperidinofluoran, 2-chloro-3-(N-methyltoluidino)-7-(p-n-butylanilino)fluoran, 3-(N-methyl-N-isopropylamino)-6-methyl-7-anilinofluoran, 3-di-n-butylamino-6-methyl-7-anilinofluoran, 3,6-bis (dimethylamino)fluorenespiro(9,3')-6'-dimethylaminophthalide, 3-(N-benzyl-N-cyclohexylamino)-5,6-benzo-7-α-naphthylamino-4'-bromofluoran, 3-diethylamino-6-chlor-7-anilinofluoran, 3-diethylamino-6-methyl-7-mesitydino-4',5'-benzofluoran, 3-N-methyl-3-isopropyl-8-methyl-7-anilinofluoran, 3-N-ethyl-N-isoamyl-6-methyl-7-anilinofluoran and 3-diethylamino-6-methyl-7-(2',4'-dimethylanilino)fluoran.

The developer used in the thermosensitive recording layer of the present invention is an electron-accepting compound and may be selected from a variety of electron-accepting materials capable of reacting with the leuco dye and making the leuco dye develop color when heated. Examples thereof include a variety of conventionally known electron-accepting developers; among these, such a developer as the one described in JP-A No. 63-95979 is particularly suitable for the present invention, and use thereof makes it possible to achieve stability of a color-developed image.

Specific examples of the developer are shown below.

Amino Group-Containing Salicylic Acid Derivatives

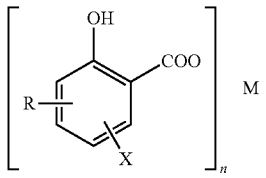

In the formula, R denotes a substituted amino group, X denotes any one of a hydrogen atom, an alkyl group, a phenyl group, an alkoxy group or a halogen atom, M denotes a hydrogen atom or a metal atom having a valence of n, and n denotes an integer.

Among substituted amino groups denoted by R in the formula, acylamino groups, arylsulfonylamino groups, alkylaminocarbonylamino groups, arylaminocarbonylamino groups, dialkylamino groups and alkylarylamino groups, which have 2 to 18 carbon atoms, are preferable. Among substituents denoted by X in the formula, hydrogen atom, alkyl groups having 1 to 18 carbon atoms, alkoxy groups having 1 to 20 carbon atoms, phenyl group, chlorine atom and fluorine atom are preferable. Among groups denoted by M in the formula, hydrogen atom, zinc atom, aluminum atom, magnesium atom and calcium atom are preferable.

Specific examples of the salicylic acid derivatives include 4-myristoylaminosalicylic acid, 4-decanoylaminosalicylic acid, 4-phenylacetylaminosalicylic acid, 4-phenoxyacetylaminosalicylic acid, 4-benzoylaminosalicylic acid, 4-toluoylaminosalicylic acid, 4-N-stearylcarbamoylaminosalicylic acid, 4-N-phenylcarbamoylaminosalicylic acid, 4-P-toluenesulfonylaminosalicylic acid, 4-dibenzylaminosalicylic acid, 5-myristoylaminosalicylic acid, 5-phenylacetylaminosalicylic acid, 5-benzoylaminosalicylic acid and metal salts thereof. Each of these may be used alone or in combination with two or more.

Also, electron-accepting compounds such as already well-known salicylic acid derivatives other than the salicylic acid derivatives, phenol derivatives, phenol resins and acid clay may be used together with the salicylic acid derivatives. Examples thereof include 4-tert-butylphenol, 4-phenylphenol, 4-hydroxydiphenoxide, α-naphthol, β-naphthol, hexyl 4-hydroxybenzoate, 2,2'-dihydroxybiphenyl, 2,2-bis(4-hydroxyphenyl)propane(bisphenol A), 4,4'-isopropylidenebis (2-methylphenol), 1,1'-bis-(3-chloro-4-hydroxyphenyl)cyclohexane, 1,1'-bis(3-chloro-4-hydroxyphenyl)-2-ethylbutane, 4,4'-sec-isooctylidenediphenol, 4-tert-octylphenol, 4,4'-sec-butylidenediphenol, 4-p-methylphenylphenol, 4,4'-isopentylidenephenol, 4,4'-methylcyclohexylidenediphenol, 4,4'-dihydroxydiphenylsulfide, 1,4-bis(4'-hydroxycumyl) benzene, 1,3-bis(4"-hydroxycumyl)benzene, 4,4'-thiobis(6-tert-butyl-3-methylphenol), 4,4'-dihydroxydiphenylsulfone, hydroquinone monobenzyl ether, 4-hydroxybenzophenone, 2,4-dihydroxybenzophenone, polyvinylbenzyloxycarbonylphenol, 2,4,4'-trihydroxybenzophenone, 2,2',4,4'-tetrahydroxybenzophenone, 4-hydroxyphthalic acid, dimethyl-methyl 4-hydroxybenzoate, 2,4,4'-trihydroxydiphenylsulfone, 1,5-bis-p-hydroxyphenylpentane, 1,6-bis-p-hydroxyphenoxyhexane, tolyl 4-hydroxybenzoate, 4-hydroxybenzoic acid α-phenylbenzyl ester, phenylpropyl 4-hydroxybenzoate, phenethyl 4-hydroxybenzoate, p-chlorobenzyl 4-hydroxybenzoate, p-methoxybenzyl 4-hydroxybenzoate, 4-hydroxybenzoic acid benzyl ester, 4-hydroxybenzoic acid m-chlorobenzyl ester, 4-hydroxybenzoic acid β-phenethyl ester, 4-hydroxy2',4'-dimethyldiphenylsulfone β-phenethyl orsellinate, cinnamyl orsellinate, orsellinic acid-o-chlorophenoxyethyl ester, o-ethylphenoxyethyl orsellinate, o-phenylphenoxyethyl orsellinate, m-phenylphenoxyethyl orsellinate, 2,4-dihydroxybenzoic acid-β-3'-tert-butyl-4'-hydroxyphenoxyethyl ester, 4-N-benzylsulfamoylphenol, 2,4-dihydroxybenzoic acid-β-phenoxydiethyl ester, 2,4-dihydroxy-6-methyl-benzoic acid benzyl ester, methyl bis-4-hydroxyphenylacetate, ditolylthiourea, 4,4'-diacetyldiphenylthiourea, 3-phenylsalicylic acid, 3-cyclohexylsalicylic acid, 3,5-di-tert-butylsalicylic acid, 3-methyl-5-benzylsalicylic acid, 2-phenyl-5-(α,α-dimethylbenzyl)salicylic acid, 3,5-di-(α-methylbenzyl)salicylic acid, 5-tert-octylsalicylic acid, 3-chloro-5-cumylsalicylic acid, 3-methyl-5-tert-octylsalicylic acid, 3-methyl-5-α-methylbenzylsalicylic acid, 3-methyl-5-cumylsalicylic acid, 3,5-di-tert-aminosalicylic acid, 3-phenyl-5-benzylsalicylic acid, 3-phenyl-5-tert-octylsalicylic acid, 3-phenyl-5-α-methylbenzylsalicylic acid, 3,5-di-tert-octylsalicylic acid, 3,5-bis(α-methylbenzyl)salicylic acid, 3,5-dicumylsalicylic acid, α-methyl-5-(α-methylbenzyl)salicylic acid, 4-methyl-5-cumylsalicylic acid, 3-(α-methylbenzyl)-6-methylsalicylic acid, 3-(α-methylbenzyl)-6-phenylsalicylic acid, 3-triphenylmethylsalicylic acid, 3-diphenylmethylsalicylic acid, 4-n-dodecylsalicylic acid, 4-tert-dodecylsalicylic acid, 4-n-pentadecylsalicylic acid, 4-n-heptadecylsalicylic acid, 5-(1,3-diphenylbutyl)salicylic acid, 5-n-octadecylsalicylic acid, 5-dodecylsulfonylsalicylic acid, 5-dodecylsulfosalicylic acid and 3-methyl-5-dodecylsulfosalicylic acid.

Also in the present invention, it is not that the developer is limited to the above-mentioned compounds but that the developer may also be selected from many other electron-accepting compounds exemplarily shown below, including octadecylphosphonic acid. In the thermosensitive recording material of the present invention, 1 part by mass to 20 parts by mass, preferably 2 parts by mass to 10 parts by mass, of the developer is contained in relation to 1 part by mass of the color former also contained. The developer may be a single developer or a combination of two or more developers. Likewise, the color former may be a single color former or a combination of two or more color formers.

The developer may be selected from a variety of electron-accepting materials capable of reacting with the leuco dye and making the leuco dye develop color when heated. Specific examples thereof include the phenolic materials, the organic and inorganic acid materials, and the esters and the salts thereof that are shown below.

Octadecylphosphonic acid, gallic acid, salicylic acid, 3-isopropylsalicylic acid, 3-cyclohexylsalicylic acid, 3,5-di-tert-butylsalicylic acid, 3,5-di-α-methylbenzylsalicylic acid, 4,4'-isopropylidenediphenol, 1,1'-isopropylidenebis(2-chlorophenol), 4,4'-isopropylidenebis(2,6-dibromophenol), 4,4'-isopropylidenebis(2,6-dichlorophenol), 4,4'-isopropylidenebis(2-methylphenol), 4,4'-isopropylidenebis(2,6-dimethylphenol), 4,4-isopropylidenebis(2-tert-butylphenol), 4,4'-sec-butylidenediphenol, 4,4'-cyclohexylidenebisphenol, 4,4'-cyclohexylidenebis(2-methylphenol), 4-tert-butylphenol, 4-phenylphenol, 4-hydroxydiphenoxide, α-naphthol, β-naphthol, 3,5-xylenol, thymol, methyl-4-hydroxybenzoate, 4-hydroxyacetophenone, novolac-type phenol resins, 2,2'-thiobis(4,6-dichlorophenol), catechol, resorcin, hydroquinone, pyrogallol, phloroglycine, phloroglycinecarboxylic acid, 4-tert-octylcatechol, 2,2'-methylenebis(4-chlorophenol), 2,2'-methylenebis(4-methyl-6-tert-butylphenol), 2,2-dihydroxydiphenyl, ethyl p-hydroxybenzoate, propyl p-hydroxybenzoate, butyl p-hydroxybenzoate, benzyl p-hydroxybenzoate, p-chlorobenzyl p-hydroxybenzoate, o-chlorobenzyl p-hydroxybenzoate, p-methylbenzyl p-hydroxybenzoate, n-octyl p-hydroxybenzoate, benzoic acid, zinc salicylate, 1-hydroxy-2-naphthoic acid, 2-hydroxy-6-naphthoic acid, zinc 2-hydroxy-6-naphthoate, 4-hydroxydiphenylsulfone, 4-hydroxy-4'-chlorodiphenylsulfone, bis(4-hydroxyphenyl)sulfide, 2-hydroxy-p-toluic acid, zinc 3,5-di-tert-butylsalicylate, tin 3,5-di-tert-butylsalicylate, tartaric acid, oxalic acid, maleic acid, citric acid, succinic acid, stearic acid, 4-hydroxyphthalic acid, boric acid, thiourea derivatives, 4-hydroxythiophenol derivatives, bis(4-hydroxyphenyl)acetic acid, bis(4-hydroxyphenyl)ethyl acetate, bis(4-hydroxyphenyl)n-propyl acetate, bis(4-hydroxyphenyl)m-butyl acetate, bis(4-hydroxyphenyl)phenyl acetate, bis(4-hydroxyphenyl)benzyl acetate, bis(4-hydroxyphenyl)phenethyl acetate, bis(3-methyl-4-hydroxyphenyl)acetic acid, bis(3-methyl-4-hydroxyphenyl)methyl acetate, bis(3-methyl-4-hydroxyphenyl)n-propyl acetate, 1,7-bis(4-hydroxyphenylthio)3,5-dioxaheptane, 1,5-bis(4-hydroxyphenylthio) 3-oxaheptane, dimethyl 4-hydroxyphthalate, 4-hydroxy-4'-methoxydiphenylsulfone, 4-hydroxy-4'-ethoxydiphenylsulfone, 4-hydroxy-4'-isopropoxydiphenylsulfone, 4-hydroxy-4'-propoxydiphenylsulfone, 4-hydroxy-4'-butoxydiphenylsulfone, 4-hydroxy-4'-isobutoxydiphenylsulfone, 4-hydroxy-4-butoxydiphenylsulfone, 4-hydroxy-4'-tert-butoxydiphenylsulfone, 4-hydroxy-4'-benzyloxydiphenylsulfone, 4-hydroxy-4'-phenoxydiphenylsulfone, 4-hydroxy-4'-(m-methylbenzyloxy)diphenylsulfone, 4-hydroxy-4'-(p-methylbenzyloxy)diphenylsulfone, 4-hydroxy-4'-(o-methylbenzyloxy)diphenylsulfone and 4-hydroxy-4'-(p-chlorobenzyloxy)diphenylsulfone.

In the thermosensitive recording layer of the present invention, if necessary, supplemental additives commonly used for this type of thermosensitive recording material, such as a water-soluble polymer, an aqueous emulsion resin, a filler, a thermofusible material and a surfactant, may also be contained together with the leuco dye and the developer.

In this case, examples of the filler include fine inorganic powders of calcium carbonate, silica, zinc oxide, titanium oxide, aluminum hydroxide, zinc hydroxide, barium sulfate, clay, talc, surface-treated potassium and surface-treated silica; and fine organic powders of urea-formalin resins, styrene-methacrylic acid copolymers and polystyrene resins. Examples of the thermofusible material include higher fatty acids, and esters, amides and metal salts thereof; waxes; condensation products of aromatic carboxylic acids and amines; benzoic acid phenyl esters; higher straight-chain glycols; 3,4-epoxy-dialkyl hexahydrophthalate; higher ketones; p-benzylbiphenyl; and other thermofusible organic compounds having melting points of approximately 50° C. to 200° C.

The binder resin used in the thermosensitive recording layer of the present invention may be selected from a variety of known resins exemplified by polyethylene, polyvinyl acetate, polyacrylamide, maleic acid copolymers, polyacrylic acid and esters thereof, polymethacrylic acid and esters thereof, vinyl chloride-vinyl acetate copolymers, styrene copolymers, polyesters, polyurethane, polyvinyl butyral, ethyl cellulose, polyvinyl acetal, polycarbonates, epoxy resins, polyamides, polyvinyl alcohol, starch and gelatin. Each of these resins may be used alone or in combination with two or more.

The thermosensitive recording layer of the present invention is produced by uniformly dispersing or dissolving a leuco dye, a developer and the like along with a binder resin, then applying this mixture onto a support and drying this mixture. The method of applying the mixture is not particularly limited and may be selected from die fountain method, wire bar method, gravure method, air knife method and so forth. Among these methods, die fountain method whereby the mixture can be applied onto the support without needing direct contact between a coater and the support is preferable in that uniformity of the applied layer can be obtained. The particle diameter of the dispersed materials in the recording layer solution greatly affects the glossiness of the recording material as a whole, or the surface roughness of the protective layer, and further, dot reproducibility at the time of printing; therefore, it is desirable that the volume average particle diameter of the dispersed materials be 2.0 μm or less, particularly 1.0 μm or less. As for the glossiness of the recording layer surface, when the surface glossiness measured in accordance with JIS P-8142 is set at 40% or greater with respect to {GS (75°)}, the glossiness of the recording material as a whole and the uniformity of an image improve remarkably.

Although the thickness of the recording layer depends upon the composition of the recording layer and how the thermosensitive recording material is used, it is preferably 1 μm to 50 μm or so, more preferably 3 μm to 20 μm or so. Aldo, if necessary, various additives such as a surfactant may be added into the recording layer coating solution for the purpose of improving its coating capability and the recording properties of the recording layer.

As to the thermosensitive recording material of the present invention, a protective layer can be provided on the thermosensitive recording layer for the purpose of, for example, improving the capability of the thermosensitive recording material to match a thermal head or the like and further enhancing the storage stability of a recorded image, and provision of the protective layer is very favorable. In this case, the protective layer may contain a resin, a filler and/or a lubricant (wax, oil, etc.) and may, if necessary, contain a cross-linking agent, a surfactant, a pressure-based color development preventing agent, etc., and further, a water-resistant agent.

Specific examples of the filler include inorganic fillers such as phosphate fibers, potassium titanate, needle-like magnesium hydroxide, whiskers, talc, mica, glass flakes, calcium carbonate, plate-like calcium carbonate, aluminum hydroxide, plate-like aluminum hydroxide, silica, clay, fired clay, kaolin and hydrotalcite; and organic fillers such as cross-linked polystyrene resin particles, urea-formalin copolymer particles, silicone resin particles, cross-linked polymethacrylic acid methyl acrylate resin particles, guanamine-formaldehyde copolymer particles and melamine-formaldehyde copolymer particles.

In the present invention, in view of preventing head abrasion, melamine-formaldehyde copolymer particles are preferable among the organic fillers, and kaolin, talc and aluminum hydroxide are preferable among the inorganic fillers. It should, however, be noted that the present invention is not limited thereto, and that a plurality of fillers may be used at the same time to yield various properties.

As to the resin used in the protective layer, an aqueous emulsion, a hydrophobic resin, an ultraviolet ray curable resin, an electron beam curable resin, etc. may, if necessary, be used in addition to a water-soluble resin similar to the one used in the recording layer. Specific examples of the resin include water-soluble resins such as poly(meth)acrylamide resins, polyvinyl alcohol, cellulose derivatives, starch and derivatives thereof, carboxyl group-modified polyvinyl alcohol, polyacrylic acid and derivatives thereof, styrene-acrylic acid copolymers and derivatives thereof, poly(meth)acrylamide and derivatives thereof, styrene-acrylic acid-acrylamide copolymers, amino group-modified polyvinyl alcohol, epoxy-modified polyvinyl alcohol, polyethyleneimine, aqueous polyesters, aqueous polyurethane, and isobutylene-maleic anhydride copolymers and derivatives thereof; polyesters, polyurethane, acrylic acid ester (co)polymers, styrene-acrylic copolymers, epoxy resins, polyvinyl acetate, polyvinylidene chloride, polyvinyl chloride and copolymers thereof; polyacrylic acid ester resins, polymethacrylic acid ester resins, polyurethane resins, polyester resins, polyvinyl acetate resins, styrene acrylate resins, polyolefin resins, polystyrene resins, polyvinyl chloride resins, polyether resins, polyamide resins, polycarbonate resins, polyethylene resins and polypropylene resins. Among these, preference is given to water-soluble resins, particularly diacetone-modified polyvinyl alcohol. Also, use of a cross-linking agent in addition to any of the resins is effective.

The cross-linking agent may be selected from conventionally known compounds such as isocyanate compounds, epoxy compounds and aldehydes. Among these, isocyanate compounds are particularly preferable, and specific examples thereof include tolylene diisocyanate, diphenylmethane diisocyanate, xylylene diisocyanate, isophorone diisocyanate, hexamethylene diisocyanate, hydrogenated diphenylmethane diisocyanate, hydrogenated xylylene diisocyanate, tetramethyl-m-xylylene diisocyanate, norbornane diisocyanate, and compounds in which each molecule contains two or more isocyanate groups, such as derivatives of those isocyanate compounds. Examples of the isocyanate derivatives include those of prepolymer type, uretedione type, allophanate type, dimer type, isocyanurate type, burette type and adduct type with trimethylolpropane; and use of a hydrazide compound is preferable.

As for the amount of the cross-linking agent added, although the appropriate amount varies depending upon the resin and the cross-linking agent used, it is preferably 10% by mass to 100% by mass or so in relation to the amount of the resin.

To further improve the capability of the thermosensitive recording material to match a thermal head, a wax and/or an oil may be added to the protective layer, or a silicone-modified resin may be mixed as a binder resin to the protective layer. The coefficient of friction can be adjusted, for example by adjusting the ratio of the resin to the filling agent. Examples of waxes able to be herein used include stearic acid amide, palmitic acid amide, oleic acid amide, lauric acid amide, ethylenebisstearylamide, methylenebisstearylamide, methylolstearylamide, paraffin waxes, polyethylene, carnauba waxes, paraffin oxide and zinc stearate. Examples of oils able to be herein used include ordinary silicone oils.

The method of applying the protective layer is not particularly limited and may be selected from conventionally known methods. The thickness of the protective layer is preferably 0.1 μm to 20 μm, more preferably 0.5 μm to 10 μm. When the protective layer is too thin, it does not fully function as a protective layer, as it fails to improve the storage stability of the recording material, the capability thereof to match a thermal head, etc. When the protective layer is too thick, the thermal sensitivity of the recording material lowers, and also there is a disadvantage caused in terms of cost.

As to the thermosensitive recording material of the present invention, it is possible to provide an intermediate layer between the thermosensitive recording layer and the protective layer for the purpose of, for example, improving water resistance and chemical resistance. In this case, the resin constituting the intermediate layer is similar to the resin constituting the protective layer. Examples thereof include water-soluble resins such as polyvinyl alcohol, cellulose derivatives, starch and derivatives thereof, carboxyl group-modified polyvinyl alcohol, polyacrylic acid and derivatives thereof, styrene-acrylic acid copolymers and derivatives thereof, poly (meth)acrylamide and derivatives thereof, styrene-acrylic acid-acrylamide copolymers, amino group-modified polyvinyl alcohol, epoxy-modified polyvinyl alcohol, polyethyleneimine, aqueous polyesters, aqueous polyurethane, and isobutylene/maleic anhydride copolymers and derivatives thereof; and polyesters, polyurethane, acrylic acid ester (co) polymers, styrene-acrylic copolymers, epoxy resins, polyvinyl acetate, polyvinylidene chloride, polyvinyl chloride and copolymers thereof.

Besides any of the resins, the intermediate layer may contain a surfactant, and further, a cross-linking agent.

The method of applying the intermediate layer is not particularly limited and may be selected from conventionally known methods. The thickness of the intermediate layer is preferably 1 μm to 5 μm, more preferably 2 μm to 3 μm. When the intermediate layer (barrier layer) is too thin, it does not fully function as an intermediate layer, as it fails to improve water resistance, chemical resistance, etc. When the intermediate layer is too thick, the thermal sensitivity of the recording material lowers, and also there is a disadvantage caused in terms of cost.

In order to reduce curling of the recording material and decrease the adhesion of the recording material such that its transportability at the time of printing with an imager can be improved, it is desirable that a back layer containing a matte agent composed of fine particles be provided on the surface of the support opposite to the surface thereof on which the thermosensitive recording layer is provided. Also, various additives such as a resin, a cross-linking agent, an antistatic agent, a filler and a surfactant for improvement in coating capability may be added into the back layer. When the matte agent is composed of fine inorganic particles, the recording material is easily caused to have scratches as it rubs against the fine inorganic particles; accordingly, use of fine resin particles makes it possible to prevent scratches caused by rubbing and improve the adhesion. Examples of the fine resin particles include cross-linked polystyrene resin particles, urea-formalin resin particles, silicone resin particles, cross-linked polymethacrylic acid methyl acrylate resin particles and melamine-formaldehyde resin particles. The average diameter of the fine resin particles is preferably 20 μm or less. When it is greater than 20 μm, protrusions on the surface of the back layer are conspicuous, which causes a reduction in appearance-related quality. The average diameter is more preferably 10 μm to 15 μm. When it is less than 5 μm, there is less improvement in adhesion.

The amount of the fine resin particles added is 0.5% by mass to 10% by mass in relation to the amount of the resin constituting the back layer. When it is greater than 10% by mass, transparency is impaired. When it is less than 0.5% by mass, there is less improvement in adhesion. The amount is preferably 1% by mass to 5% by mass or so.

The back layer can be obtained by applying onto the support a coating solution which contains at least an isobutylene-maleic anhydride copolymer ammonium salt and an aziridine compound, and drying the coating solution. The back layer contains an isobutylene-maleic anhydride copolymer ammonium salt, and an aziridine compound and/or a cross-linked product of the isobutylene-maleic anhydride copolymer ammonium salt and the aziridine compound.

For the resin, an isobutylene-maleic anhydride copolymer ammonium salt is used; however, other resins may be additionally used, in which case those resins preferably have favorable adhesiveness to the support. Examples thereof include acrylic resins, styrene resins, polyester resins, epoxy resins, polyvinyl resins and polycarbonates.

The molecular weight of the isobutylene-maleic anhydride copolymer ammonium salt is preferably 10,000 to 100,000. When it is 10,000 or less, the adhesiveness of the resin to the support decreases. When it is 100,000 or greater, the resin has such a high viscosity that the viscosity is difficult to adjust to an appropriate viscosity for coating.

The resin containing an isobutylene-maleic anhydride copolymer ammonium salt is superior in curl correcting effect but makes it easier for cracks to arise in the coating surface when a film is folded; it should be noted that the cracking can be reduced by mixing a styrene-butadiene resin, a low Tg acrylic resin or a polyvinyl alcohol resin with the resin. In particular, by mixing a polyvinyl alcohol resin with the resin, it is possible to reduce the cracking without lessening the curl correcting effect much. In this case, the mass ratio of the isobutylene-maleic anhydride copolymer ammonium salt to the polyvinyl alcohol in the back layer coating solution is preferably in the range of 3/7 to 9/1. In view of reducing both cracking and curling, the mass ratio of the isobutylene-maleic anhydride copolymer ammonium salt to the polyvinyl alcohol is more preferably in the range of 5/5 to 7/3.

As for the amount of the isobutylene-maleic anhydride copolymer ammonium salt used in the present invention, when the isobutylene-maleic anhydride copolymer ammonium salt is contained in the back layer so as to occupy 50% by mass or more of the total mass of the back layer, it is favorable because there is a remarkable curl reducing effect.

Addition of a cross-linking agent for cross-linking terminal functional groups of components contained in the back layer is effective because the back layer can be increased in strength and further increased in curl reducing effect. For the cross-linking agent, an aziridine compound is used; however, other conventionally known compounds such as an isocyanate compound, an epoxy compound and an aldehyde may be additionally used. An aziridine compound is preferable because it yields a higher cross-linking speed than other cross-linking agents do, and cross-linking proceeds without needing a special treatment after coating (for example, storage at a high temperature).

Specific examples of the aziridine compound include 2,2-bis(hydroxymethyl)butanoltris[3-(1-aziridinyl)propionate], trimethylolpropane-tri-6-aziridinylpropionate, tetramethylolmethane-tri-6-aziridinylpropionate, N,N'-diphenylmethane-4,4'-bis(1-aziridinecarboxamido), N,N'-hexamethylene-1,6'-bis(1-aziridinecarboxamido) and N,N'-toluene-2,4'-bis(1-aziridinecarboxamido).

The aziridine compound exhibits its effects when the amount of the aziridine compound is 0.1 parts by mass in relation to 1 part by mass that is the total amount of an isobutylene-maleic anhydride copolymer, and a polystyrene sulfonic acid salt or a copolymer of styrene sulfonic acid and maleic acid. When the amount is less than 0.1 parts by mass, cross-linking hardly proceeds, and thus there is a reduction in water resistance. To improve water resistance further, the amount is preferably 0.2 parts by mass to 1 part by mass. Even when the amount is greater than 1 part by mass, the effects do not heighten.

The filler is added especially for the purpose of forming depressions and protrusions on the layer surface so as to prevent firm adhesion between films, and making the surface appropriately rough so as to reduce its glossiness and thereby obtain a less conspicuous surface. To prevent firm adhesion between the films, it is desirable to use a filler having a particle diameter that is larger than the back layer thickness, for example a filler made of a spherical organic pigment having a volume average particle diameter of 12 μm or greater, because the filler can be prevented from being embedded in the back layer. To reduce the glossiness of the surface, it is desirable to use an amorphous inorganic pigment having a volume average particle diameter of 1 μm to 3 μm, together with a spherical organic pigment having a volume average particle diameter of 5 μm to 7 μm. The glossiness of the back layer is preferably 10% to 30%.

Specific examples of the filler include inorganic pigments such as phosphate fibers, potassium titanate, needle-like magnesium hydroxide, whiskers, talc, mica, glass flakes, calcium carbonate, plate-like calcium carbonate, aluminum hydroxide, plate-like aluminum hydroxide, silica, clay, fired clay, kaolin and hydrotalcite; and organic pigments such as cross-linked polystyrene resin particles, urea-formalin copolymer particles, silicone resin particles, cross-linked polymethacrylic acid methyl acrylate resin particles, guanamine-formaldehyde copolymer particles and melamine-formaldehyde copolymer particles. It should, however, be noted that the filler in the present invention is not limited thereto.

As to the suitable amounts of the pigments added, the amount of the amorphous inorganic pigment having a volume average particle diameter of 1 μm to 3 μm is 0.2 parts by mass to 0.8 parts by mass, the amount of the spherical organic pigment having a volume average particle diameter of 5 μm to 7 μm is 0.1 parts by mass to 0.3 parts by mass, and the amount of the spherical organic pigment having a volume average particle diameter of 12 μm or greater is 0.01 parts by mass to 0.05 parts by mass, in relation to 1 part by mass that is the total amount of the resin (isobutylene-maleic anhydride copolymer ammonium salt and/or polyvinyl alcohol).

Whether a pigment has an amorphous form or a spherical form is judged by enlarging the pigment with a microscope (at a magnification of approximately 500 times, when the particle diameter is 5 μm to 7 μm) in an observation.

The antistatic agent may, for example, be selected from commonly used ion-conducting antistatic agents and electron-conducting antistatic agents. Specific examples of the ion-conducting antistatic agents include inorganic salts such as sodium chloride; anionic polymers such as sodium polystyrenesulfonate; and resins containing quaternary ammonium salts that are electrolyte cations. Specific examples of the electron-conducting antistatic agents include conductive metal compounds such as conductive tin and antimony oxide; and conductive polymers such as polyaniline. Among these antistatic agents, polystyrene sulfonic acid salts, in particular, react with aziridine, thereby improving water resistance obtained by means of cross-linkage. Additionally, salts which have copolymerized with maleic acid are effective in that they have antistatic properties and also improve water resistance. Each of these antistatic agents exhibits an antistatic effect, as 0.2 parts by mass of it is contained in the back layer in relation to 1 part by mass of the isobutylene-maleic anhydride copolymer ammonium salt also contained therein. In a particularly harsh low-humidity environment, each of these antistatic agents exhibits a remarkable antistatic effect, as 1 part by mass to 3 parts by mass of it is contained in the back layer in relation to 1 part by mass of the isobutylene-maleic anhydride copolymer ammonium salt also contained therein.

The method of applying the back layer is not particularly limited and may be selected from conventionally known methods. The thickness of the back layer is 1 μm to 50 μm or so, preferably 2 μm to 20 μm or so.

As to the method for forming images with the use of the thermosensitive recording material of the present invention, the thermosensitive recording material is heated imagewise by a heating unit on the basis of information concerning letters/characters and/or shapes. The heating unit is not particularly limited and may be suitably selected from a thermal pen, a thermal head, laser heating, etc. in accordance with the intended use. It should, however, be noted that the thermosensitive recording material is suitable for printing high-definition, high-tone images such as medical images on, and use of a thermal head for the printing is most favorable, also in terms of the cost, output speed and miniaturization of an apparatus.

In view of medical uses, it is necessary for the images to have tonal variety, and the images may be provided with tonal variety by a pulse control method or a voltage control method.

EXAMPLES

The following explains the present invention in further detail by means of Examples. Note that the term "part" and the symbol "%" used below are both based upon mass.

Example 1

A recording layer coating solution was prepared by pulverizing and dispersing the following composition so as to have an average particle diameter of 0.3 μm, with the use of a ball mill.

| [A solution] | |
|---|---|
| 2-anilino-3-methyl-6-diethylaminofluoran | 2 parts |
| Octadecylphosphonic acid | 6 parts |
| Polyvinyl butyral (DENKA BUTYRAL #3000-2, produced by Denki Kagaku Kogyo Kabushiki Kaisha) | 3 parts |
| Toluene | 22 parts |
| Methyl ethyl ketone | 22 parts |

The coating solution [A solution] prepared as described above was applied onto a biaxially-stretched polypropylene film (support) (FGS-200, produced by YUPO CORPORATION) having a thickness of 200 μm and dried at 70° C. for 1 min, and a thermosensitive recording layer having a thickness of 11 μm was thus formed.

Next, a [B Solution] was prepared by mixing the following composition.

| [B solution] | |
|---|---|
| Guanamine-formaldehyde copolymer particles (EPOSTAR S, which has an average particle diameter of 0.3 μm, produced by Nippon Shokubai Co., Ltd.) | 1 part |
| Silicone-modified polyvinyl butyral resin (SP-712, which has a solid content of 12.5%, produced by Nippon Fine Chemical) | 80 parts |
| Polyvinyl acetoacetal resin solution (KS-1, a 10% MEK solution, produced by Sekisui Chemical Co., Ltd.) | 10 parts |
| Methyl ethyl ketone | 119 parts |

The protective layer coating solution [B solution] prepared as described above was subjected to ultrasonic treatment for 15 min, then this solution was applied onto the previously obtained thermosensitive recording layer and dried at 70° C. for 1 min, and a protective layer having a thickness of 2.5 μm was thus provided.

| [C solution] | |
|---|---|
| Isobutylene-maleic anhydride copolymer ammonium salt (ISOBAN 304 ammonia, which has a solid content of 21%, produced by Kuraray Co., Ltd.) | 48 parts |
| Tin oxide-antimony composite (SN-100D, which has a solid content of 30%, produced by Ishihara Sangyo Kaisha, Ltd.) | 10 parts |
| 2,2-bis(hydroxymethyl)butanoltris[3-(1-aziridinyl)propionate] (CHEMITITE PZ-33, produced by Nippon Shokubai Co., Ltd.) | 1 part |
| Water | 82 parts |

A back layer coating solution [C solution] was prepared by sufficiently mixing and agitating the above-mentioned composition. This coating solution was applied onto the back surface of the support already coated with the protective layer, so as to have a thickness of 3 μm, and dried at 70° C. for 1 min, and a back layer was thus formed. A thermosensitive recording material of the present invention was thereby obtained.

Example 2

A recording material of the present invention was obtained in a manner similar to the process of obtaining the one in Example 1, except that the back layer coating solution was changed to a [D solution] having the following composition.

| [D solution] | |
|---|---|
| Isobutylene-maleic anhydride copolymer ammonium salt (ISOBAN 304 ammonia, which has a solid content of 21%, produced by Kuraray Co., Ltd.) | 48 parts |
| Polystyrene sulfonic acid ammonium salt (CHEMISTAT SA-101, which has a solid content of 30%, produced by Sanyo Chemical Industries, Ltd.) | 9 parts |
| 2,2-bis(hydroxymethyl)butanoltris[3-(1-aziridinyl)propionate] (CHEMITITE PZ-33, produced by Nippon Shokubai Co., Ltd.) | 1 part |
| Water | 83 parts |

Example 3

A recording material of the present invention was obtained in a manner similar to the process of obtaining the one in Example 1, except that the back layer coating solution was changed to an [E solution] having the following composition.

| [E solution] | |
|---|---|
| Isobutylene-maleic anhydride copolymer ammonium salt (ISOBAN 304 ammonia, which has a solid content of 21%, produced by Kuraray Co., Ltd.) | 48 parts |
| Na salt of a copolymer of styrene sulfonic acid and maleic acid (VERSA TL-3, which has a solid content of 100%, produced by Nippon NSC Ltd.) | 3 parts |
| 2,2-bis(hydroxymethyl)butanoltris[3-(1-aziridinyl)propionate] (CHEMITITE PZ-33, produced by Nippon Shokubai Co., Ltd.) | 1 part |
| Water | 89 parts |

Example 4

A recording material of the present invention was obtained in a manner similar to the process of obtaining the one in Example 1, except that the back layer coating solution was changed to an [F solution] having the following composition.

| [F solution] | |
|---|---|
| Isobutylene-maleic anhydride copolymer ammonium salt (ISOBAN 304 ammonia, which has a solid content of 21%, produced by Kuraray Co., Ltd.) | 48 parts |
| Na salt of a copolymer of styrene sulfonic acid and maleic acid (VERSA TL-3, which has a solid content of 100%, produced by Nippon NSC Ltd.) | 10 parts |
| 2,2-bis(hydroxymethyl)butanoltris[3-(1-aziridinyl)propionate] (CHEMITITE PZ-33, produced by Nippon Shokubai Co., Ltd.) | 1 part |
| Water | 152 parts |

Example 5

A recording material of the present invention was obtained in a manner similar to the process of obtaining the one in Example 1, except that the back layer coating solution was changed to a [G solution] having the following composition.

| [G solution] | |
|---|---|
| Isobutylene-maleic anhydride copolymer ammonium salt (ISOBAN 304 ammonia, which has a solid content of 21%, produced by Kuraray Co., Ltd.) | 48 parts |
| Na salt of a copolymer of styrene sulfonic acid and maleic acid (VERSA TL-3, which has a solid content of 100%, produced by Nippon NSC Ltd.) | 10 parts |
| 2,2-bis(hydroxymethyl)butanoltris[3-(1-aziridinyl)propionate] (CHEMITITE PZ-33, produced by Nippon Shokubai Co., Ltd.) | 3 parts |
| Water | 171 parts |

Example 6

A recording material of the present invention was obtained in a manner similar to the process of obtaining the one in Example 1, except that the back layer coating solution was changed to an [H solution] having the following composition.

| [H solution] | |
|---|---|
| Isobutylene-maleic anhydride copolymer ammonium salt (ISOBAN 304 ammonia, which has a solid content of 21%, produced by Kuraray Co., Ltd.) | 38 parts |
| 10% polyvinyl alcohol aqueous solution (10% aqueous solution of PVA117, produced by Kuraray Co., Ltd.) | 20 parts |
| Na salt of a copolymer of styrene sulfonic acid and maleic acid (VERSA TL-3, which has a solid content of 100%, produced by Nippon NSC Ltd.) | 10 parts |
| 2,2-bis(hydroxymethyl)butanoltris[3-(1-aziridinyl)propionate] (CHEMITITE PZ-33, produced by Nippon Shokubai Co., Ltd.) | 3 part |
| Water | 159 parts |

Example 7

A recording material of the present invention was obtained in a manner similar to the process of obtaining the one in Example 1, except that the back layer coating solution was changed to an [I solution] having the following composition.

| [I solution] | |
|---|---|
| Isobutylene-maleic anhydride copolymer ammonium salt (ISOBAN 304 ammonia, which has a solid content of 21%, produced by Kuraray Co., Ltd.) | 38 parts |
| 10% polyvinyl alcohol aqueous solution (10% aqueous solution of PVA117, produced by Kuraray Co., Ltd.) | 20 parts |
| Na salt of a copolymer of styrene sulfonic acid and maleic acid (VERSA TL-3, which has a solid content of 100%, produced by Nippon NSC Ltd.) | 10 parts |
| Polymethyl methacrylate spherical fine particles (MX-1500, which has a volume average particle diameter of 15 μm, produced by Soken Chemical & Engineering Co., Ltd.) | 0.02 parts |

-continued

| [I solution] | |
|---|---|
| Polymethyl methacrylate spherical fine particles (MA-1006, which has a volume average particle diameter of 6 μm, produced by Nippon Shokubai Co., Ltd.) | 0.2 parts |
| Silica fine particles (MIZUKASIL P-527, produced by Mizusawa Industrial Chemicals, Ltd.) | 0.3 parts |
| 2,2-bis(hydroxymethyl)butanoltris[3-(1-aziridinyl)propionate] (CHEMITITE PZ-33, produced by Nippon Shokubai Co., Ltd.) | 3 parts |
| Water | 164 parts |

Comparative Example 1

A recording material for comparison was produced in a manner similar to the process of obtaining the one in Example 1, except that the back layer was not provided.

Comparative Example 2

A recording material of Comparative Example 2 was obtained in a manner similar to the process of obtaining the one in Example 1, except that the back layer coating solution was changed to a [J solution] having the following composition.

| [J solution] | |
|---|---|
| 10% polyvinyl alcohol aqueous solution (10% aqueous solution of PVA117, produced by Kuraray Co., Ltd.) | 100 parts |
| Tin oxide-antimony composite (SN-100D, which has a solid content of 30%, produced by Ishihara Sangyo Kaisha, Ltd.) | 10 parts |
| 2,2-bis(hydroxymethyl)butanoltris[3-(1-(aziridinyl)propionate] CHEMITITE PZ-33, produced by Nippon Shokubai Co., Ltd.) | 1 part |
| Water | 29 parts |

The thermosensitive recording materials of Examples and Comparative Examples obtained as described above were stored for 24 hr in an oven set at a temperature of 40° C. and thus sufficiently dried, then each of the thermosensitive recording materials was evaluated in accordance with the following testing methods.

(Curling of Film Before Printing)

Each thermosensitive recording material was cut into a sheet of A4 and placed on a flat stand such that the thermosensitive recording surface faced upward, then the heights of lifted four angles were measured, the maximum value was defined as the measurement value of curling, and each thermosensitive recording material was evaluated in accordance with the following criteria.

A: 2 mm or less in the value of curling

B: 3 mm to 5 mm in the value of curling

C: 6 mm to 10 mm in the value of curling

D: 10 mm or greater in the value of curling (Curling of Film After Printing)

A gray solid image having a reflection density of approximately 1.5 was printed onto each thermosensitive recording material, using a printer with variable application energy, which incorporated a thermal head having a resolution of 300 dpi, then curling of each thermosensitive recording material was measured in a manner similar to the measurement of curling thereof before printing. The reflection density was measured using the reflection densitometer RD-914 manufactured by Macbeth Co.

(Cracking)

Each thermosensitive recording material was left to stand at a temperature of 10° C. and a humidity of 20% for 4 hr, then it was once wound around a column having a diameter of 20 mm, with its back surface placed facing outward; subsequently, the back surface that had been unwound was observed and evaluated in accordance with the following criteria.

A: there was no cracking

B: there was partial cracking

C: there was cracking on the entire surface (Glossiness)

The glossiness of the surface on the back surface side of each thermosensitive recording material was measured at an angle of 75° using VG-1001GP(S) manufactured by Nippon Denshoku Industries Co., Ltd.

A: less than 30% in glossiness

B: 30% to 50% in glossiness

C: 50% or greater in glossiness (Adhesiveness Between Films)

Each thermosensitive recording material was cut into two 10 cm×10 cm films, these films were laid on top of each other such that the front surface of one film came into contact with the back surface of the other, and these films were stored for 24 hr under a load of 10 kg/(10 cm×10 cm). After the storage, the adhesion between the films was evaluated in accordance with the following criteria.

A: the two films detached from each other without resistance

B: there was firm adhesion between parts of the two films, and there was a little resistance C: there was firm adhesion between the entire surfaces of the two films The evaluation results are shown in Table 1 below. Table 1 reveals the fact that the present invention has provided a thermosensitive recording material which is capable of reducing curling before and after printing and which is excellent in glossiness and adhesiveness between films.

(Measurement of Electrostatic Charge)

Three sheets of each thermosensitive recording material were continuously printed with evaluation images in the A4 size in a normal temperature environment (23° C. in temperature and 50% in RH) and also in a low-temperature and low-humidity environment (10° C. in temperature and 10% in RH), using the thermal printer UP-D70XR manufactured by Sony Corporation, and the amount of electrostatic charge at the time of film discharge was measured using DESCO ELECTRIC FIELD METER MODEL No. 19445.

A; less than 1 KV in the amount of electrostatic charge

B: 1 KV or greater, and less than 5 KV in the amount of electrostatic charge

C: 5 KV or greater in the amount of electrostatic charge (Water Resistance)

One droplet of water was applied dropwise onto the surface of each sample, using a syringe; 10 seconds afterward, the water was wiped off with force, using gauze, and then the trace of water was visually evaluated.

A: there was no trace

B: there was a trace to some extent

C: there was complete peeling of film

TABLE 1

| | Curling before printing | Curling after printing | Electrostatic charge at normal temperature | Electrostatic charge at low humidity | Water resistance | Cracking | Glossiness | Adhesion between films |
|---|---|---|---|---|---|---|---|---|
| Ex 1 | B | B | A | B | A | B | A | A |
| Ex 2 | B | B | A | B | B | B | C | B |
| Ex 3 | B | B | A | B | A | B | C | B |
| Ex 4 | B | B | A | A | B | B | C | B |
| Ex 5 | B | B | A | A | A | B | C | B |
| Ex 6 | B | B | A | A | A | A | C | B |
| Ex 7 | B | B | A | A | A | A | A | A |
| Comp Ex 1 | D | D | C | C | A | A | C | C |
| Comp Ex 2 | D | D | A | B | C | A | C | C |

Reference Example 1

(1) Base Film A

A base film used was formed of synthetic paper having a five-layer structure, composed of (i) and (ii) below. The base film had a thickness of 188 μm±5 μm, a surface glossiness of 95%, a smoothness of 11,000 sec, a stiffness of 400 mg in MD, and a stiffness of 600 mg in CD.

(i) Base Layer

A composition composed of 95% by mass of polypropylene and 5% by mass of calcium carbonate having an average particle diameter of 1 μm was biaxially stretched to 178 μm so as to serve as a base layer.

(ii) Front Surface layer

A 2 μm film produced by biaxially stretching polypropylene and a 3 μm film produced by biaxially stretching polypropylene were laid over the base layer to serve as a front surface layer having a two-layer structure. Also, a layer having the same structure as the front surface layer was formed over the back surface of the base layer as well.

| (2) Preparation of thermosensitive recording layer coating solution | |
|---|---|
| [K solution] Preparation of dye dispersion solution | |
| 2-anilino-3-methyl-6-dibutylaminofluoran | 20 parts |
| 10% aqueous solution of polyvinyl alcohol | 20 parts |
| Water | 60 parts |
| [L solution] Developer dispersion solution | |
| 4-hydroxy-4'-isopropoxydiphenylsulfone | 12 parts |
| Silica | 4 parts |
| Stearic acid amide | 4 parts |
| 10% aqueous solution of polyvinyl alcohol | 20 parts |
| Water | 60 parts |
| [M solution] Thermosensitive recording layer solution | |
| K solution | 12.5 parts |
| L solution | 62.5 parts |
| 10% aqueous solution of polyvinyl alcohol | 25 parts |

The compositions containing the above-mentioned respective ingredients were each pulverized using a magnetic ball mill so as to have an average particle diameter of 2.5 μm, and the [K solution] and the [L solution] were thus prepared. Subsequently, the thermosensitive recording layer solution [M solution] was prepared by mixing and agitating 12.5 parts of the [K solution], 62.5 parts of the [L solution], and 25 parts of modified polyvinyl alcohol (KURARAY K-POLYMER KL-318, which has a solid content of 10%).

The thermosensitive recording layer solution [M solution] was applied onto the base film A, using a wire bar, and dried for 3 min with a dryer that was set at a temperature of 70° C., and an 8.5 g/m$^2$ thermosensitive recording layer A (having a surface glossiness of 38%) was thus formed.

| (3) Preparation of top layer coating solution | |
|---|---|
| [N solution] Filler dispersion solution | |
| Calcium carbonate (Brt 15) | 20 parts |
| 10% aqueous solution of polyvinyl alcohol | 20 parts |
| Water | 60 parts |
| [O solution] Top layer solution | |
| Core-shell resin (BARIASTAR B 20% solution, produced by Mitsui Chemicals, Inc.) | 30 parts |
| Zinc stearate emulsion solution (K-994, which has a solid content of 20% and a volume average particle diameter of 0.2 μm, produced by Chukyo Yushi Co., Ltd) | 7 parts |
| Filler dispersion solution (N solution) (which has a volume average particle diameter of 0.2 μm) | 30 parts |
| Water | 66 parts |
| Aziridine compound (CHEMITITE PZ-332, produced by Nippon Shokubai Co., Ltd.) | 2 parts |

The composition containing the above-mentioned ingredients was pulverized using a magnetic ball mill so as to prepare the [O solution] having a volume average particle diameter of 0.2 μm, and the [O solution] was mixed and agitated so as to prepare a top layer E solution. The top layer E solution was applied onto the thermosensitive recording layer A, using a wire bar, and dried for 3 min with a dryer that was set at a temperature of 70° C., and a 3 g/m$^2$ top layer was thus formed. A sample of Reference Example 1 was thereby produced.

The surface glossiness of the top layer of Reference Example 1 was 68%.

Reference Example 2

A sample of Reference Example 2 was produced in the same manner as the process of producing the one of Reference Example 1, except that the K solution and the L solution, both of which had been prepared so as to have an average particle diameter of 1.0 μm, were used and the thermosensitive recording layer solution [M solution] was used. On this occasion, the surface glossiness of a thermosensitive recording layer B was 43%, and the surface glossiness of a top layer of Reference Example 2 was 78%.

Reference Example 3

| (4) Preparation of back layer coating solution | |
|---|---|
| [P solution] Back layer solution | 45 parts |
| 10% aqueous solution of polyvinyl alcohol | 40 parts |
| Silica (P527, produced by Mizusawa Industrial Chemicals, Ltd.) | 1 part |
| Antistatic agent (CHEMISTAT KM-7005) | 10 parts |
| Polyamide epichlorohydrin (Paper Strength Agent WS-525, 25%) | 4 parts |

The P solution was applied onto the back surface side of the sample of Reference Example 2 and dried so as to serve as a 4 g/m$^2$ back layer. A sample of Reference Example 3 was thereby produced.

Comparative Example 3

(1) Base Film B

A base film used was formed of synthetic paper having a three-layer structure, composed of (i) and (ii) below. The base film had a thickness of 180 μm±5 μm, a surface glossiness of 60%±10%, a smoothness of 2,800 sec, a stiffness of 240 mg in MD, and a stiffness of 320 mg in CD.

(i) Base Layer

A composition composed of 80% by mass of polypropylene and 20% by mass of calcium carbonate having an average particle diameter of 1 μm was biaxially stretched to 120 μm so as to serve as a base layer.

(ii) Paper-Like Layer

A 30 μm film produced by uniaxially stretching a paper-like layer composed of 55% by mass of polypropylene and 45% by mass of calcium carbonate having an average particle diameter of 1 μm was formed over the base layer. Also, a layer having the same structure as the paper-like layer was formed over the back surface of the base layer as well.

The same recording layer coating solution as the one in Reference Example 1 was applied onto the base film B, using a wire bar, and dried for 3 min with a dryer that was set at a temperature of 70° C., and an 8.5 g/m$^2$ thermosensitive recording layer C (having a surface glossiness of 32%) was thus formed.

A top layer E solution was applied onto the thermosensitive recording layer C, using a wire bar, and dried for 3 min with a dryer that was set at a temperature of 70° C., and a 3 g/m$^2$ top layer was thus formed. A sample of Comparative Example 3 was thereby produced. The surface glossiness of the top layer of Comparative Example 3 was 52%.

Comparative Example 4

(1) Base Film C

A base film used was formed of synthetic paper having a three-layer structure, composed of (i) and (ii) below. The base film had a thickness of 195 μm±5 μm, a surface glossiness of 10%±5%, a smoothness of 600 sec, a stiffness of 340 mg in MD, and a stiffness of 760 mg in CD.

(i) Base Layer

A composition composed of 80% by mass of polypropylene and 20% by mass of calcium carbonate having an average particle diameter of 1 μm was biaxially stretched to 120 μm so as to serve as a base layer.

(ii) Paper-Like Layer

A 30 μm film produced by uniaxially stretching a paper-like layer composed of 35% by mass of polypropylene and 65% by mass of calcium carbonate having an average particle diameter of 1 μm was formed over the base layer. Also, a layer having the same structure as the paper-like layer was formed over the back surface of the base layer as well.

A recording layer solution [M solution] was applied onto the base film C, using a wire bar, and dried for 3 min with a dryer that was set at a temperature of 70° C., and an 8.5 g/m$^2$ thermosensitive recording layer D (having a surface glossiness of 18%) was thus formed.

A top layer E solution was applied onto the thermosensitive recording layer D, using a wire bar, and dried for 3 min with a dryer that was set at a temperature of 70° C., and a 3 g/m$^2$ top layer was thus formed. A sample of Comparative Example 4 was thereby produced. The surface glossiness of the top layer of Comparative Example 4 was 42%.

The property values of each of the thermosensitive recording materials of Reference Examples and Comparative Examples produced as described above were measured as follows.

1. Particle Diameter

The particle diameter was measured using the laser diffraction particle size measuring device LA-920 manufactured by Horiba, Ltd. (refractive index 170a001).

2. Glossiness

The glossiness was measured by the glossiness meter MODEL 1001DP 75° manufactured by Nippon Denshoku Industries Co., Ltd. The greater the value is, the higher the glossiness is.

3. Smoothness

The smoothness was measured using an Oken-type smoothness meter.

4. Stiffness

The stiffness was measured using a Gurley-type stiffness tester (the sample was 1 inch in length, the distance of the measurement point from the axial center was 2 inches, and the load was 200 g).

Also, each of the thermosensitive recording materials of Reference Examples and Comparative Examples produced as described above was evaluated for 1. image uniformity and 2. curling.

1. Image Uniformity

A solid image having a reflection density of 1.0 was printed onto each thermosensitive recording material, using the energy-variable dry imager HORIZON (produced by Codonics, Inc.) that incorporates a tone head with a resolution of 300 dpi, and the uniformity of the solid image was judged by visual observation.

A: very uniform

B: uniform

C: somewhat nonuniform

D: extremely rough

2. Curling

Each sample was cut into a sheet of A4 and placed flat at a temperature of 22° C. and an RH of 50%, and the degrees of curling at its four corners were measured, with the maximum value being chosen for display. The greater the value is, the greater, in other words more troublesome, the curling is.

| Result concerning Properties | | | | |
|---|---|---|---|---|
| | Surface glossiness of recording layer | Stiffness (MD) | Stiffness (CD) | Stiffness (MD/CD ratio) |
| Reference Example 1 | 38% | 400 mg | 600 mg | 0.7 |
| Reference Example 2 | 43% | 400 mg | 600 mg | 0.7 |
| Reference Example 3 | 43% | 400 mg | 600 mg | 0.7 |
| Comparative Example 3 | 32% | 240 mg | 320 mg | 0.8 |
| Comparative Example 4 | 18% | 340 mg | 760 mg | 0.4 |

| Evaluation Result | | |
|---|---|---|
| | Image uniformity | Curling |
| Reference Example 1 | B | +5 |
| Reference Example 2 | A | +5 |
| Reference Example 3 | A | 0 |
| Comparative Example 3 | C | +6 |
| Comparative Example 4 | D | +12 |

What is claimed is:

1. A thermosensitive recording material comprising:

a support, a thermosensitive recording layer composed mainly of a leuco dye and a developer, provided on one surface of the support, and a back layer provided on the other surface of the support, wherein the back layer contains an isobutylene-maleic anhydride copolymer ammonium salt, and at least one of an aziridine compound, and a cross-linked product of the isobutylene-maleic anhydride copolymer ammonium salt and the aziridine compound, wherein the thickness of the back layer is 1 μM to 50 μM, and wherein the aziridine compound is 2,2-bis(hydroxymethyl)butanoltris[3-(1-aziridinyl)propionatel].

2. The thermosensitive recording material according to claim 1, wherein the back layer further contains an antistatic agent.

3. The thermosensitive recording material according to claim 2, wherein the antistatic agent is a polystyrene sulfonic acid salt.

4. The thermosensitive recording material according to claim 2, wherein the antistatic agent is a salt of a copolymer of styrene sulfonic acid and maleic acid.

5. The thermosensitive recording material according to claim 4, wherein in the back layer, 0.2 parts by mass to 1 part by mass of an aziridine compound is contained in relation to 1 part by mass that is the total amount of an isobutylene-maleic anhydride copolymer ammonium salt and the salt of the copolymer of styrene sulfonic acid and maleic acid also contained.

6. The thermosensitive recording material according to claim 2, wherein in the back layer, 1 part by mass to 3 parts by mass of the antistatic agent is contained in relation to 1 part by mass of an isobutylene-maleic anhydride copolymer ammonium salt also contained.

7. The thermosensitive recording material according to claim 1, wherein the back layer contains polyvinyl alcohol.

8. The thermosensitive recording material according to claim 7, wherein the back layer is obtained by applying and drying a coating solution which contains at least the isobutylene-maleic anhydride copolymer ammonium salt, the aziridine compound and the polyvinyl alcohol, and the mass ratio of the isobutylene-maleic anhydride copolymer ammonium salt to the polyvinyl alcohol in the coating solution is in the range of 3/7 to 9/1.

9. The thermosensitive recording material according to claim 1, wherein the back layer contains an amorphous inorganic pigment having a volume average particle diameter of 1 μm to 3 μm, a spherical organic pigment having a volume average particle diameter of 5 μm to 7 μm, and a spherical organic pigment having a volume average particle diameter of 12 μm or greater.

10. The thermosensitive recording material according to claim 1, wherein the support is a biaxially-stretched film composed mainly of polypropylene.

* * * * *

UNITED STATES PATENT AND TRADEMARK OFFICE

CERTIFICATE OF CORRECTION

PATENT NO. : 8,283,287 B2
APPLICATION NO. : 12/808848
DATED : October 9, 2012
INVENTOR(S) : Hideo Aihara et al.

It is certified that error appears in the above-identified patent and that said Letters Patent is hereby corrected as shown below:

Replace the Inventor's information on the Title page of the patent with the following:

-- (75) Inventors: Hideo Aihara, Fuji (JP); Ichiro Sawamura, Numazu (JP); Hiroshi Tohmatsu, Numazu (JP); Shinji Okada, Shizuoka (JP); Hirokazu Watari, Numazu (JP) --

Signed and Sealed this
Twenty-sixth Day of February, 2013

Teresa Stanek Rea
*Acting Director of the United States Patent and Trademark Office*